US005078047A

United States Patent [19]

Wimberly

[11] Patent Number: 5,078,047

[45] Date of Patent: Jan. 7, 1992

[54] SOLAR ROOF VENT

[75] Inventor: Joseph W. Wimberly, Villa Park, Ill.

[73] Assignee: Taurus Safety Products, Inc., Lombard, Ill.

[21] Appl. No.: 562,619

[22] Filed: Aug. 3, 1990

[51] Int. Cl.[5] ..... F24F 7/007

[52] U.S. Cl. ..... 454/368; 454/366; 454/900

[58] Field of Search ..... 98/42.02, 42.04, 42.13, 98/900

[56] References Cited

U.S. PATENT DOCUMENTS

| | | | |
|---|---|---|---|
| 2,831,416 | 4/1958 | Doherty | 98/42.02 |
| 3,469,519 | 9/1969 | Painter | 98/42.13 |
| 3,520,093 | 7/1970 | Painter | 98/42.13 X |
| 3,934,494 | 1/1976 | Butler | 98/42.13 |
| 4,432,273 | 2/1984 | Devitt | 98/900 X |

OTHER PUBLICATIONS

Solarex An Amoco Company, "SA-5 Amorphous Silicon Module User's Information Guide", 4/89.

*Primary Examiner*—Harold Joyce

*Attorney, Agent, or Firm*—Hill, Van Santen, Steadman & Simpson

[57] ABSTRACT

There is provided in combination with a building roof over an air space requiring forced ventilation of solar energy heated air from the space through a vent hole in the roof, an electrically operated exhaust fan mounted in air exhausting relation on the roof and over the vent hole, and a solar panel for supplying electrical power to a fan driving motor when exposed to solar rays. Air exhaust passage through the device includes a backwash turbulence preventing ring-shape plate extending between a supporting ring body which is of smaller diameter than an exhaust air directing hood on which the solar panel is mounted, and a ring channel member supporting the exhaust fan in a manner to draw the exhaust air through the ring channel into the hood.

3 Claims, 2 Drawing Sheets

SOLAR ROOF VENT

BACKGROUND OF THE INVENTION

The present invention relates to the art of ventilating the under roof spaces of buildings, such as houses, and more particularly concerns a new and improved solar roof vent.

Roof fans are well known. Heretofore, such fans have been operated by electrical motors receiving their energy from electrical power line sources and generally controlled by thermostatic switch means. That has entailed electric wiring and installation of the thermostatic controls, and all of the complexities and liabilities for malfunction inherent in such installations.

SUMMARY OF THE PRESENT INVENTION

An important object of the present invention is to provide a new and improved solar roof vent which will be self-contained, require no electric wiring outside of the unit itself and which will function automatically as the need arises.

Another object of the invention is to provide a new and improved self-contained, automatically operating solar roof vent construction of modest cost and virtual freedom from maintenance or repair problems.

A further object of the invention is to provide a new and improved method of ventilating under roof air spaces automatically in response to solar energy which is the source of roof heat causing the air space to become heated.

In accordance with the principles of the present invention, there is provided in combination with a building roof over an air space requiring forced ventilation of solar energy heated air from the space through a vent hole in the roof, and electrically operated exhaust fan, means mounting the fan in air exhausting relation on the roof and over the vent hole, and means for driving the fan comprising a solar panel supported by the mounting means for supplying motor driving electrical power to the motor when the panel is exposed to solar rays.

The present invention also provides a new and improved method of exhausting air space under a roof by utilizing a solar panel for automatically operating a roof fan in response to the solar energy which causes the under roof air space to become heated.

BRIEF DESCRIPTION OF THE DRAWINGS

Other objects, features and advantages of the present invention will be readily apparent from the following description of certain preferred embodiments thereof, taken in conjunction with the accompanying drawings, although variations and modifications may be effected without departing from the spirit and scope of the novel concepts of the disclosure, and in which.

DETAILED DESCRIPTION

Figure 1:
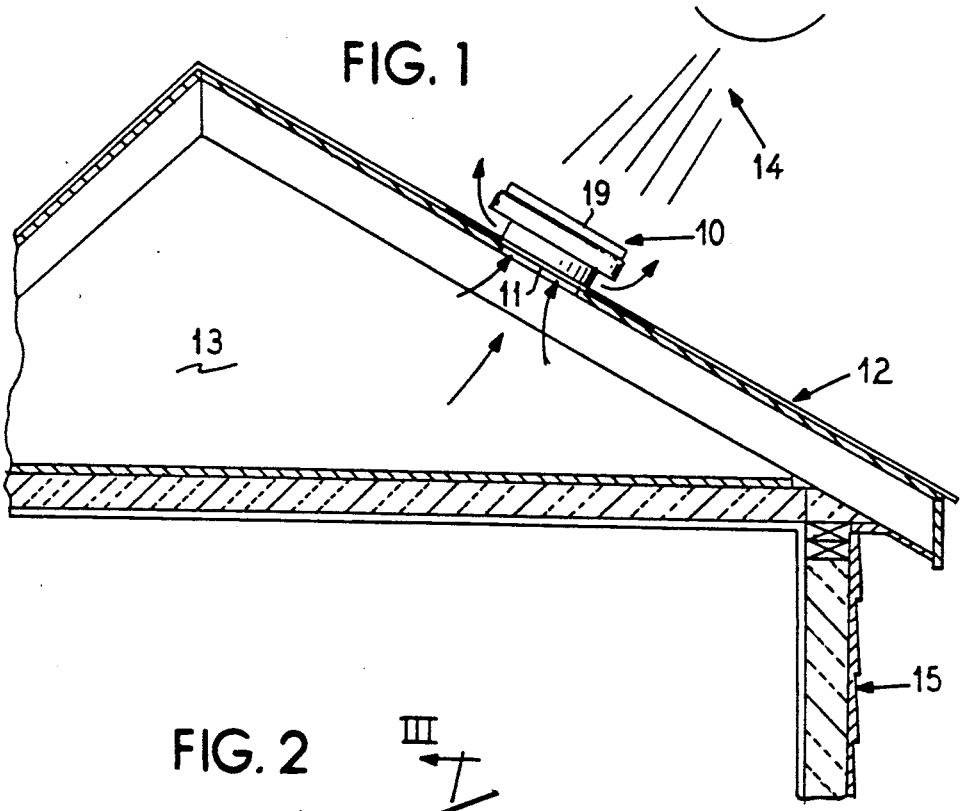
FIG. 1 is a more or less schematic fragmentary vertical sectional detail view of a roof over an air space and demonstrating a solar roof vent embodying the present invention.

A solar roof vent (FIGS. 1 and 2) is operatively mounted over a vent hole 11 on a roof 12 located over an air space 13 requiring forced ventilation of solar energy (14) heated air from the space 13 through the vent hole 11. The assembly combination just described may be part of any building, shown by way of example as a dwelling 15.

Figure 4:
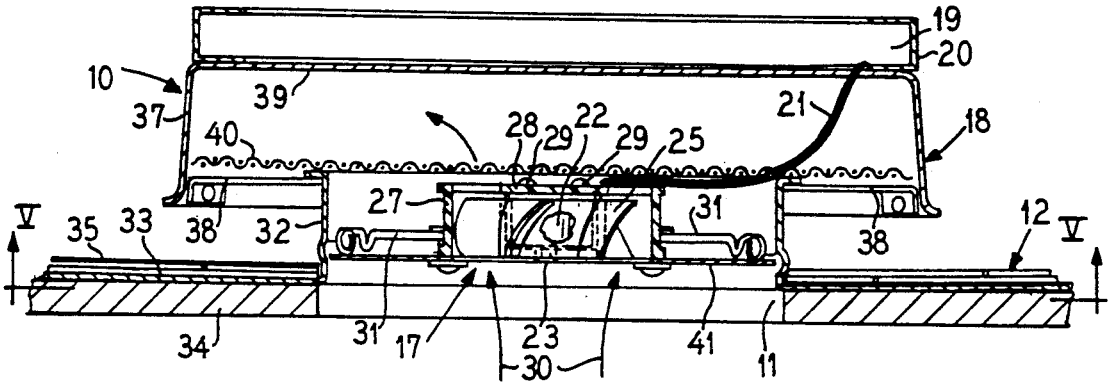
FIG. 4 is a vertical sectional detail view taken substantially along the line IV—IV in FIG. 2.
Figure 5:
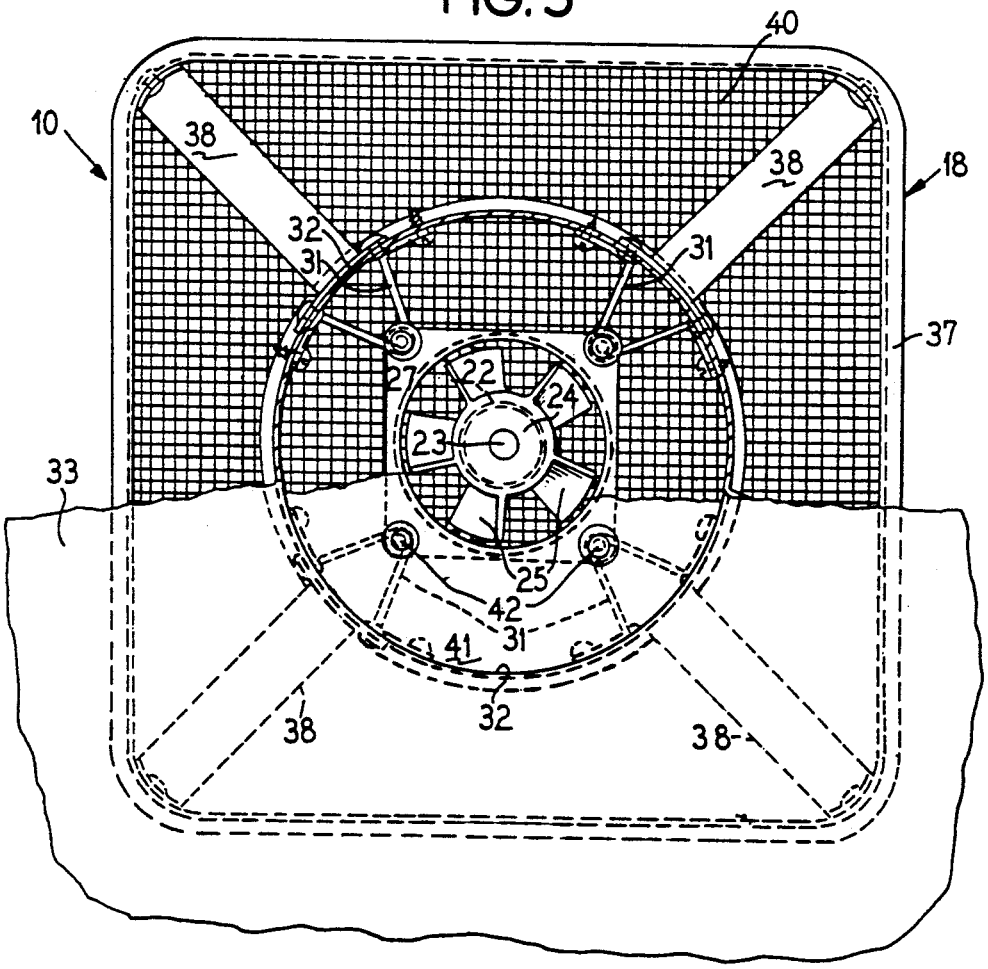
FIG. 5 is a bottom plan view taken substantially along the line V—V in FIG. 4.

In a preferred construction, the solar roof vent 10 comprises an electrical exhaust fan 17 (FIGS. 4 and 5) and means 18 for mounting the fan in air exhausting relation on the roof 12 and over the vent hole 11. Means for supplying electric power for driving the fan 17 comprises a solar panel 19 supported by the mounting means 18. In a desirable form, the solar panel 19 comprises an SA-5 amorphous silicon flat profile frame (20) solar-electric module obtainable in ready-to-install form from Solarex, 1335 Piccard Drive, Rockville, Md. 20850 USA. An electrical connection 21 supplies solar-electric power from the solar panel 19 to drive motor 22 for actuating the fan 17 which has a spindle 23 to which is corotatively attached an impeller 24 having a plurality of exhaust fan blades 25.

Mounting of the fan motor 22 within the mounting means 18 comprises a dielectric ring channel member 27 having on its upper end a supporting spider or bar 28 to which the motor 22 is suspendingly secured as by means of screws 29. Through this arrangement, the fan 17 is adapted to exhaust air, represented by arrows 30 from the space 13 upwardly through the generally short stack-like supporting ring 27.

The member 27 is, in turn, supported by means of brackets 31 bolted thereto and to an open ended tubular mounting ring body 32 which has on its lower end lateral mounting flange means 33 secured to sheathing boards 34 of the roof 12 and locked in place by shingles 35 secured over the sheathing boards 34 and the flange means 33. In a desirable form, the mounting ring body 32 is of substantially the same diameter as the vent hole 11.

Also supported on the mounting ring body 32 is a skirted deflector hood 37 of substantially larger diameter than the mounting ring body 32 and supported in free exhaust air passage concentric relation on and above the member 32 by means such as radiating attachment arms 38 attached at by means of bolts to the upper portion of the member 32 and within radius corners of the skirt of the essentially rectangular configuration of the hood 37. A horizontal wall 39 on the upper end of the generally inverted pan-shaped hood 37 provides support for the solar panel 19, the frame 20 of which is fixedly supportingly secured to the wall 39. In a desirable arrangement, the perimeter of the hood 37 is substantially the same general rectangular outline as the solar panel frame 20.

Figure 2:
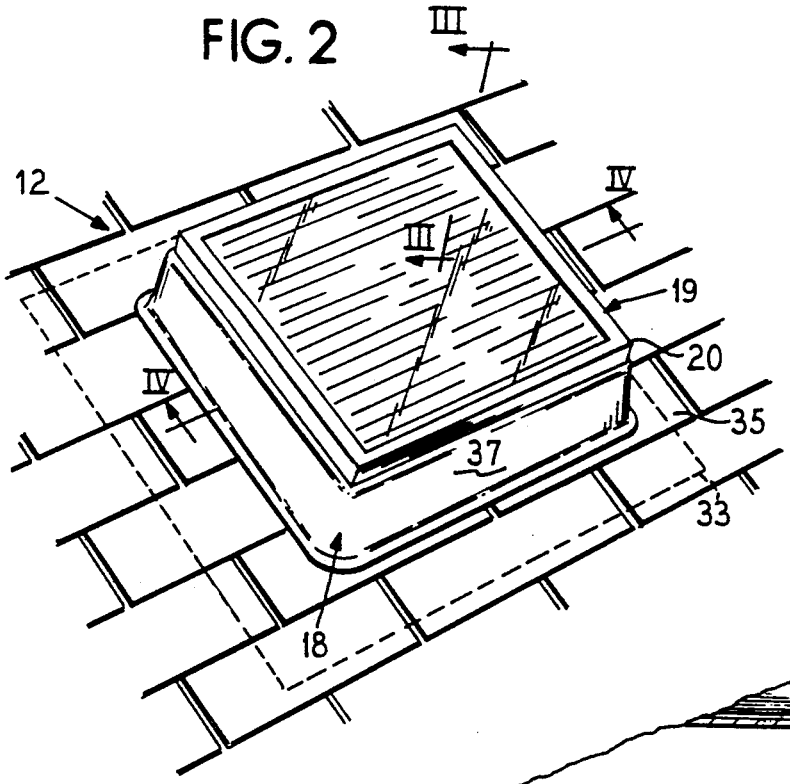
FIG. 2 is a perspective view of the solar roof vent structure and supporting roof.
Figure 3:
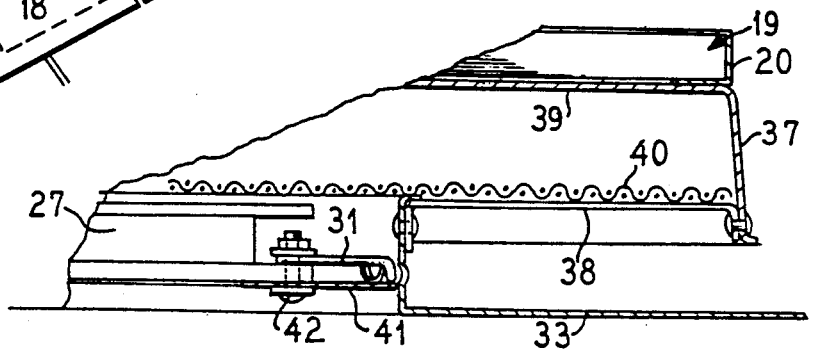
FIG. 3 is a fragmentary, enlarged sectional detail view taken substantially along the line III—III in FIG. 2.

As will be observed in FIGS. 1 and 2, the solar panel 19 is mounted facing upwardly on the top 39 of the hood 37 in a plane substantially parallel to the plane of the roof 12, and exhaust air from the fan will be deflected downwardly by the skirt of the hood 37 as will be obvious.

A screen 40 against intruding flying objects is mounted in protective relation on the upper end of the mounting member 32 and in protective relation across the gap between the top of the member 32 and the skirt of the hood 37.

In order to avoid backwash turbulence, an impervious shroud ring plate 41 of inside and outside diameters to cover the gap between the lower end of the fan channel ring 27 and the mounting member 32 is secured in place as by means of bolts 42 which also secures the brackets 31 to the member 27.

Important advantages of the solar roof vent assembly 10 reside in that it is a self-contained unit requiring no electric power source except the solar panel 19. The self-contained unitary construction of the device is compact and easy and economical to install. No control switches or thermostats are necessary. The unit works automatically in response to solar radiation, that is the photovoltaic-thin films of semi-conductive and conductive materials deposited on glass-construction of the solar panel 18 transforms light energy into electricity. For the relatively easy running fan motor 22, 12V of DC current may be provided by the panel in full sunlight, thus automatically activating the fan 17 when solar heat may accumulate in the air space 13 which the unit 10 is adapted to exhaust. In other words, the solar roof fan vent 10 automatically, efficiently, on demand exhausts the air space 13 as needed.

It will be understood that variations and modifications may be effected without departing from the spirit and scope of the novel concepts of the present invention.

I claim as my invention:

1. In a combination for mounting on a building roof having a particular plane and with a vent opening therein:

an electrical exhaust fan;

means for mounting the fan in air exhausting relation on said roof and over said vent opening;

means for supplying electrical power for driving said fan comprising a solar panel supported by said mounting means in a plane which will be in substantially parallel relation to said roof plane so as to face upwardly from the roof;

said mounting means comprising a ring-shaped member encircling a channel member of smaller diameter carrying said exhaust fan;

radiating arms connecting said channel member and ring-shaped mounting member; and a protective screen extending in a plane overlying said ring-shaped member and said channel member and said radiating arms.

2. In combination according to claim 1;

a deflector hood on said mounting means and overlying said fan in free exhaust air passage relation;

said deflector hood having a top area and air deflecting skirt means;

said solar panel being supported on said top area of the deflector hood and facing upwardly in generally parallel plane relationship to the roof;

said deflecting skirt means having reentrant corners; and radiating attachment arms extending between said corners and said mounting means.

3. A combination according to claim 1, wherein asid screen extends between said deflecting skirt means and said mounting means and overlies said attachment arms.

* * * * *